US006162157A

United States Patent [19]

Morisod

[11] Patent Number: 6,162,157

[45] Date of Patent: Dec. 19, 2000

[54] ROLLER OR BELT CORRECTION DEVICE FOR LATERAL ALIGNMENT, DURING CONVERTING, OF PARTLY FOLDED SHEET-LIKE OR PLATE-LIKE WORKPIECES IN A FOLDER-GLUER

[75] Inventor: Jean-Bernard Morisod, Villars-Ste-Croix, Switzerland

[73] Assignee: Bobst S.A., Switzerland

[21] Appl. No.: 09/388,815

[22] Filed: Sep. 1, 1999

[30] Foreign Application Priority Data

Sep. 2, 1998 [CH] Switzerland ..... 1789/98

[51] Int. Cl.[7] ..... B31B 1/04

[52] U.S. Cl. ..... 493/180; 493/128; 493/130; 493/131; 493/178

[58] Field of Search ..... 493/128, 130, 493/131, 132, 125, 178, 179, 180, 181, 182; 198/689.1, 783, 782, 586, 382, 411, 416; 271/248, 250, 276, 194, 225

[56] References Cited

U.S. PATENT DOCUMENTS

| | | | |
|---|---|---|---|
| 3,439,793 | 4/1969 | Rakestraw | 198/411 |
| 3,690,222 | 9/1972 | Schroeder . | |
| 4,387,890 | 6/1983 | Lampe | 271/225 |
| 5,400,706 | 3/1995 | Tipton et al. | 100/4 |
| 5,960,933 | 10/1999 | Albrecht | 198/689.1 |

*Primary Examiner*—Stephen F. Gerrity
*Assistant Examiner*—Sam Tawfik
*Attorney, Agent, or Firm*—Ostrolenk, Faber, Gerb & Soffen, LLP

[57] ABSTRACT

A roller or belt correction device for lateral alignment, during converting, of partly folded workpieces in a folder-gluer, consists of a lower structure above which is mounted an upper structure pivoting in the horizontal plane. This upper structure comprises a row of conveying elements which are in contact with the lower plane surface of the workpieces and which are driven by a distinct means at adjustable speed. The device comprises a guiding element which is parallely movable to a axis materializing the initial virtual line against which the workpieces have been previously supported in their upstream conveying path before being rotated in a conveying device. Applied on these workpieces, in the direction of the conveying elements forming an air permeable surface, is pressure chosen so that, added to the specific gravity of these workpieces, the resulting frictional force between the conveying elements and these workpieces is suitable to transmit to each of them a speed which is substantially equal to the speed of the conveying elements whatever the specific gravity of these workpieces may be.

22 Claims, 5 Drawing Sheets

ROLLER OR BELT CORRECTION DEVICE FOR LATERAL ALIGNMENT, DURING CONVERTING, OF PARTLY FOLDED SHEET-LIKE OR PLATE-LIKE WORKPIECES IN A FOLDER-GLUER

BACKGROUND OF THE INVENTION

The present invention refers to a roller or belt correction device for lateral alignment, during converting, of partly folded sheet-like or plate-like workpieces in a folder-gluer, which is a machine, that is commonly used in the packaging industry, for example, for manufacturing carton boxes from cut plate-like workpieces.

Working continually with moving workpieces, often in this kind of machine the folding and gluing operations are preceded by a lateral aligning operation of the travelling workpieces, this in order to avoid considerable complications at the level of the converting elements.

Such machines, which comprise a succession of modules, the number of which depend on the complexity of the manufacturing operations required by the type of box chosen, generally consist of at least a feeder feeding the box production blank by blank from a pile, a breaker prebreaking the first and third creases to 180° then reopening the blank, a module of folders with hooks, which fold the front flaps then the rear flaps of the blank to 180°, a gluing station, a helical guide and conical roller for folding the second and fourth creases of the blank, a pressing device, which compresses the second and fourth creases and arranges the boxes in a stream and, finally, a delivery module, which receives the boxes while keeping them pressed to allow the glue to dry.

The blanks are conveyed from one station to the other by means of belt conveyors, which frictionally seize the blank either between lower and upper belts or between lower belts and upper support rollers. Such lower and upper conveying devices are often associated with means for orientating the workpieces in a determined position at the inlet of the production line. In the case of folder-gluers, it is in fact necessary that each blank is accurately aligned with one lateral side parallel to the conveying direction before doing any folding operation. If this lateral alignment achieves at the inlet of the machine, generally by the feeder introducing the blanks one by one on the belt conveyors in a position being already accurately laterally aligned, no aligning device will be provided along the conveying path of the blank in the modules or stations downstream the feeder, where the travelling workpieces have already been partly converted by the folder-gluer. This is due to the fact that in a production process such as previously described, once the blank being well aligned, it can be converted into a box without the folding or gluing operations interfering with its lateral alignment.

However, some folding operations require even for the manufacturing of a very simple box a quite complex mechanism, which is expensive and sophisticated due to the production expectations imposing still higher rates with a most perfect quality. In the traveling direction of the blanks, even if a front flap can be folded without difficulty by a simple hook pivoting around a pull-back spring, the folding of the rear flaps will be a problem. In fact, the rear flaps have to be turned in their traveling direction and require a rotary folder being electronically controlled by drive motors, which constantly have to catch up in their movement with the flap since the latter tends to flee due to its traveling, while ensuring a progressive and soft folding by a path being modulated and adapted to the size of the flaps. The sheet-like or plate-like blanks having low specific gravity render such an operation and the adjustments more or even too delicate for a profitable and competitive industrial use. The application of such rotary folders on every folder-gluer irreducibly involves a considerable and undesired increase in price of the necessary equipment for the realization of a large number of jobs. This drawback mainly results from the above-mentioned manufacturing method of these boxes.

Another main drawback of such a method arises from the creation of particular boxes being made from complicated blanks, which require, to complete their transformation, more than one passage through a folder-gluer before obtaining the desired completed product.

To meet these difficulties, Swiss patent application No 1997 1274/97 proposes a belt conveying device modifying the manufacturing method by pivoting, in the horizontal plane, the travelling workpieces of low specific gravity one by one. In this invention, once the front flaps of the blank have been folded by the front hooks, it is sufficient to repeat the same operation for the rear flaps after having pivoted the blank on itself of a half-turn in the horizontal plane. This alternative complies with a double criterion aimed to improve the production, on the one hand, by reducing to half the number of passages necessary for certain boxes having a complicated folding, and, on the other hand, by reducing as much as possible the manufacturing costs of such machines.

While the pivoting of boxes avoids the expensive use of a rotary folder and reduces the number of passages in machine for the manufacture of certain types of boxes, a drawback exists of breaking off the constancy of the initial lateral alignment of the workpiece traveling in the folder-gluer.

SUMMARY OF THE INVENTION

To overcome this drawback, the present invention proposes a correction device for restoring the initial lateral alignment of any partly folded and/or glued sheet-like or plate-like workpiece, having been pivoted in the horizontal plane during converting in a folder-gluer.

For this purpose, the present invention proposes a device comprising rollers and belts for lateral alignment during converting partly folded workpieces in a folder-gluer. The devices comprises an upper structure pivotally connected to the lower structure for pivoting in a horizontal plane, said upper structure including a conveying surface on which articles to be reorientated can be supported and moved in a conveying direction; and a guide element for guiding the movement of the articles across the conveying surface along the conveying direction.

The advantages resulting from the present invention are mainly characterized by the fact that such a device allows to realize an accurate lateral alignment without any mechanical stress, necessary to ensure a perfect carrying out of the production in the linking of the subsequent folding and gluing operations of the workpieces having been previously pivoted. Effectively, the lateral alignment of unfolded plate-like workpieces achieves without any particular problem between two conveyors being slantwise arranged at the beginning of the production line, but the same does not apply when the workpieces have already been partly folded. In fact, the positioning of partly folded workpieces by a correction device equipped with a lower conveyor and a frictional upper conveyor does not allow to obtain an ideal alignment without any useless mechanical stress between the workpiece and its folded parts or between the folded parts and the upper conveyor. In the case of workpieces of low specific gravity, the pressure exerted by the upper conveyor onto the folded parts possibly damages these parts when the workpiece is realigned and leaves the upper conveyor in a slanted direction. The correction device according to the present invention uses a single lower conveyor in combination with a non mechanical supporting means able to flatten the blank on this lower conveyor, thus avoiding any mechanical stress in the blank between its various parts. In the present case, the non mechanical supporting means is given by a source creating a depression or an atmospheric excess pressure, respectively below or above the workpiece traveling on the single lower conveyor.

Another advantage is that, owing to the independent drive of its lower conveyor this correction device also allows for a transition area, in which the blanks are subject to a deceleration reducing the distance separating them. Effectively, in view of the geometry of the converted blanks, which are rarely circular, it is necessary that the spacing between the blanks is larger in the pivoting area, in the preceding module, than elsewhere in the production line. However, in order to improve the subsequent rate of the box production, it is favourable to get the initial spacing the blanks had before their introduction into the pivoting module. The correction device according to the invention also ensures this characteristic by the independent adjustment of the engine speed. The travelling workpieces can thus be subject to a deceleration during lateral realignment without any risk of damage to their previously folded parts.

In order to define a few terms introduced into the description and describing the position of certain components in the folder-gluer, we shall use the expressions "operator's side" (C.C.) and "opposite operator's side" (C.O.C.), these terms being used by general agreement to denote a particular side relative to the longitudinal central axis of the machine. This choice avoids any confusion regarding the usual terms "left" and "right", which depend on the observer's point of view. Similarly, the orientation of some axes or objects will be described by the usual terms "longitudinal" and "lateral", always with reference to the central axis of the machine, the orientation of which depends on the direction of travel of the plate-like workpieces. Finally, note that the terms "upstream" and "downstream" refer to the direction of motion of the plate-like workpieces in the folder-gluer.

BRIEF DESCRIPTION OF THE DRAWINGS

The invention will be more clearly understood from an embodiment given by way of non-limitative example and illustrated by the accompanying drawings, in which.

DESCRIPTION OF THE PREFERRED EMBODIMENTS

Figure 1:
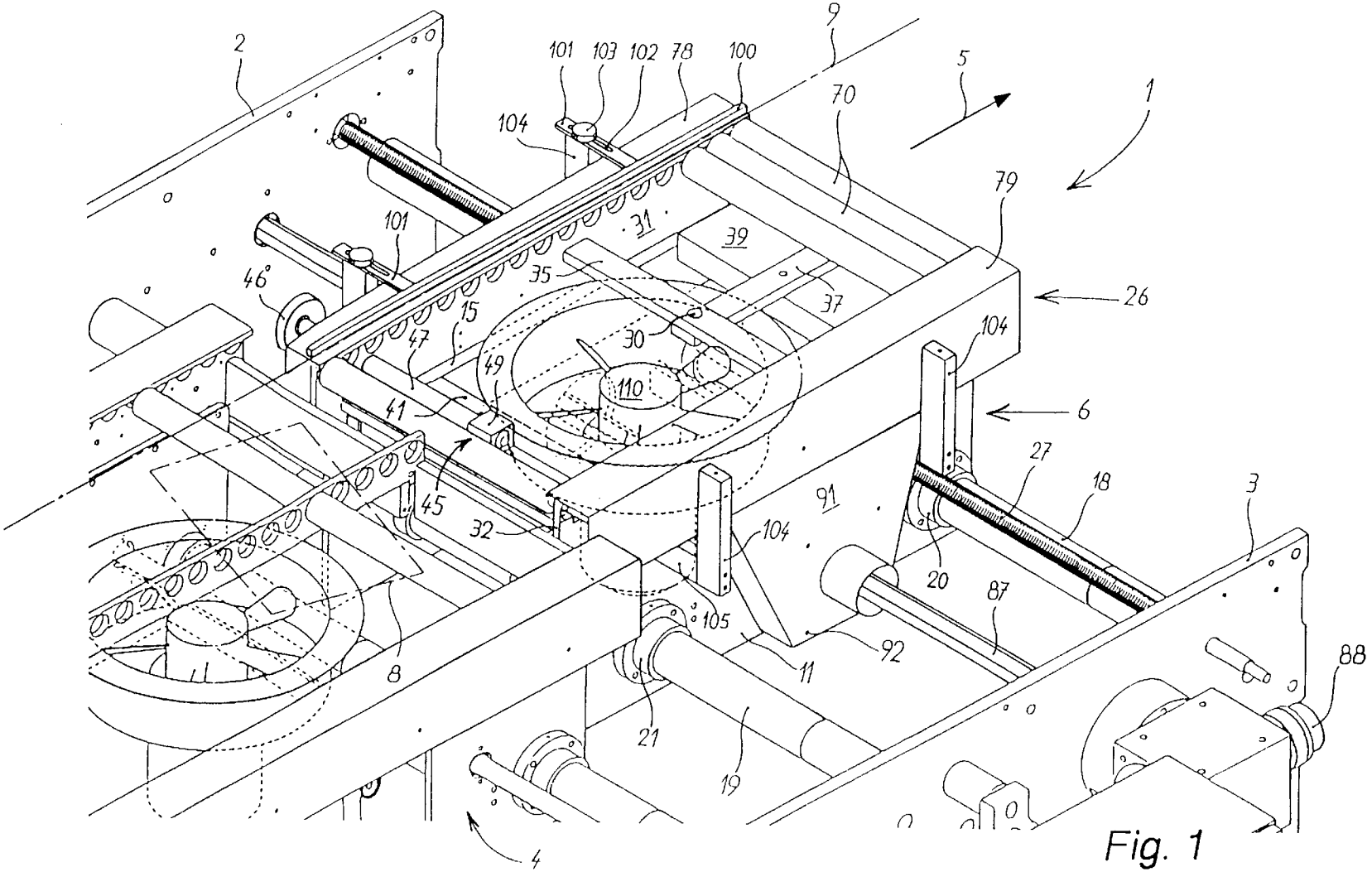
FIG. 1 is a perspective back view of the correction device arranged between the frames of the folder-gluer downstream of a pivoting module for rotating the traveling workpiece in the horizontal plane.

FIG. 1 is a general view of the correction device 1 mounted between the frames 2 (C.C.) and 3 (C.O.C.) of the folder-gluer, downstream of a pivoting module 4 for turning the workpieces 8 in the horizontal plane according to the previously cited new manufacturing method. The direction of motion of the workpieces 8 traveling above each device 1 and 4 is shown by arrow 5, and the axis 9 defining the initial virtual line against which said workpieces 8 have been supported in their upstream conveying path before being rotated in the conveying device 4.

Figure 2:
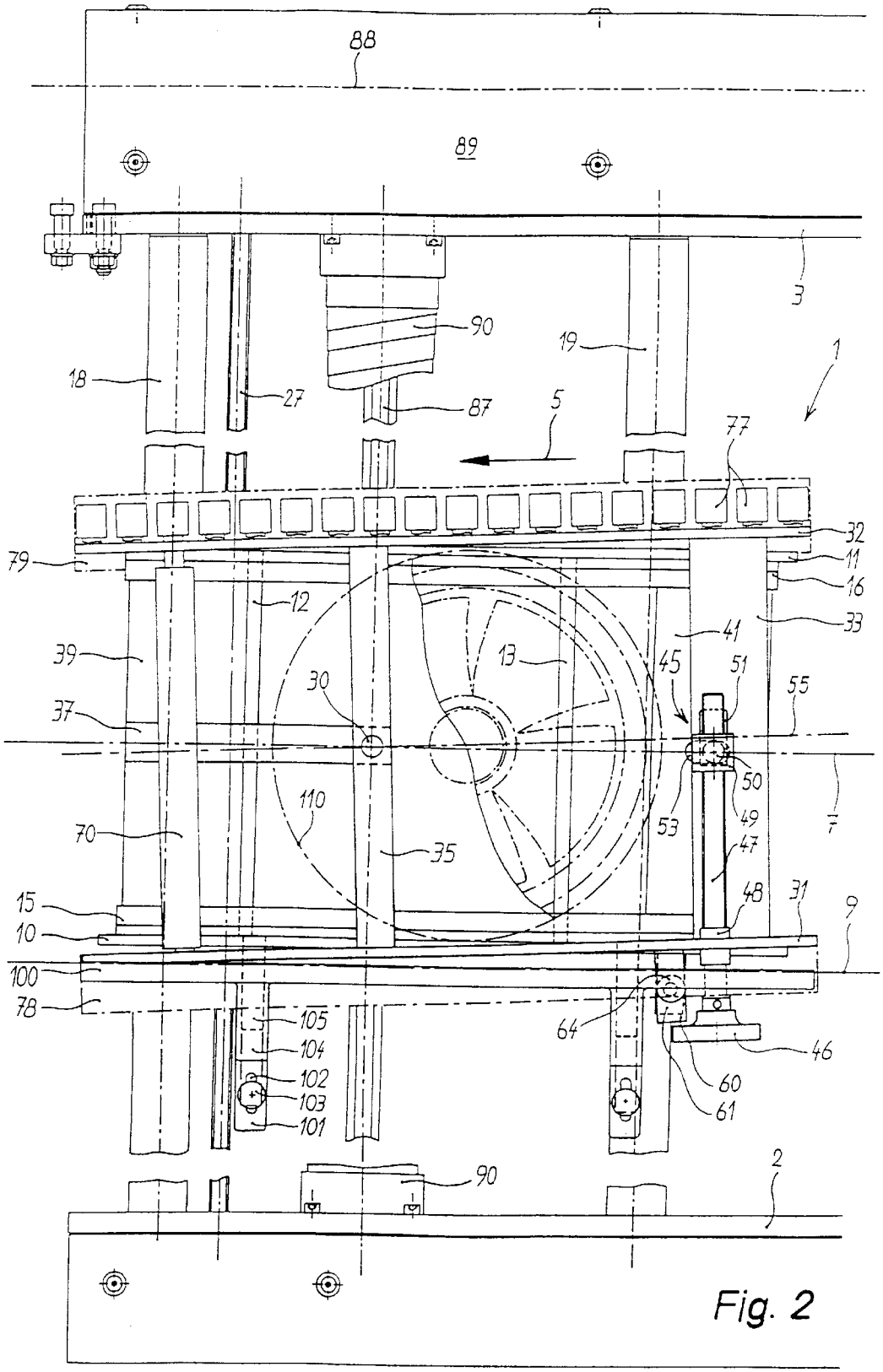
FIG. 2 is a plan view of the correction device arranged between the two frames of the folder-gluer in a slanted position turned in the horizontal plane.
Figure 3:
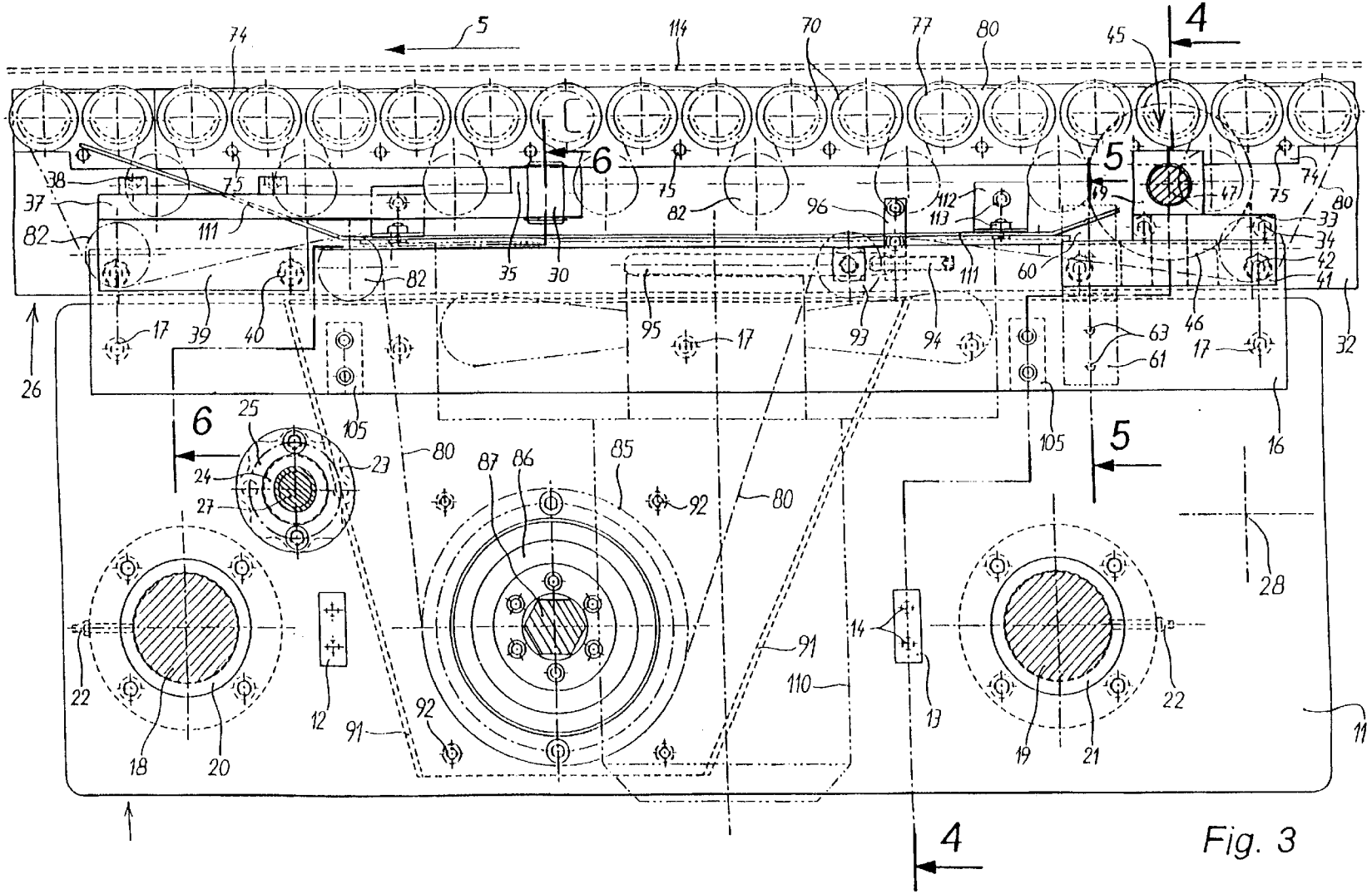
FIG. 3 is a median longitudinal sectional side view of the correction device according to the invention.
Figure 4:
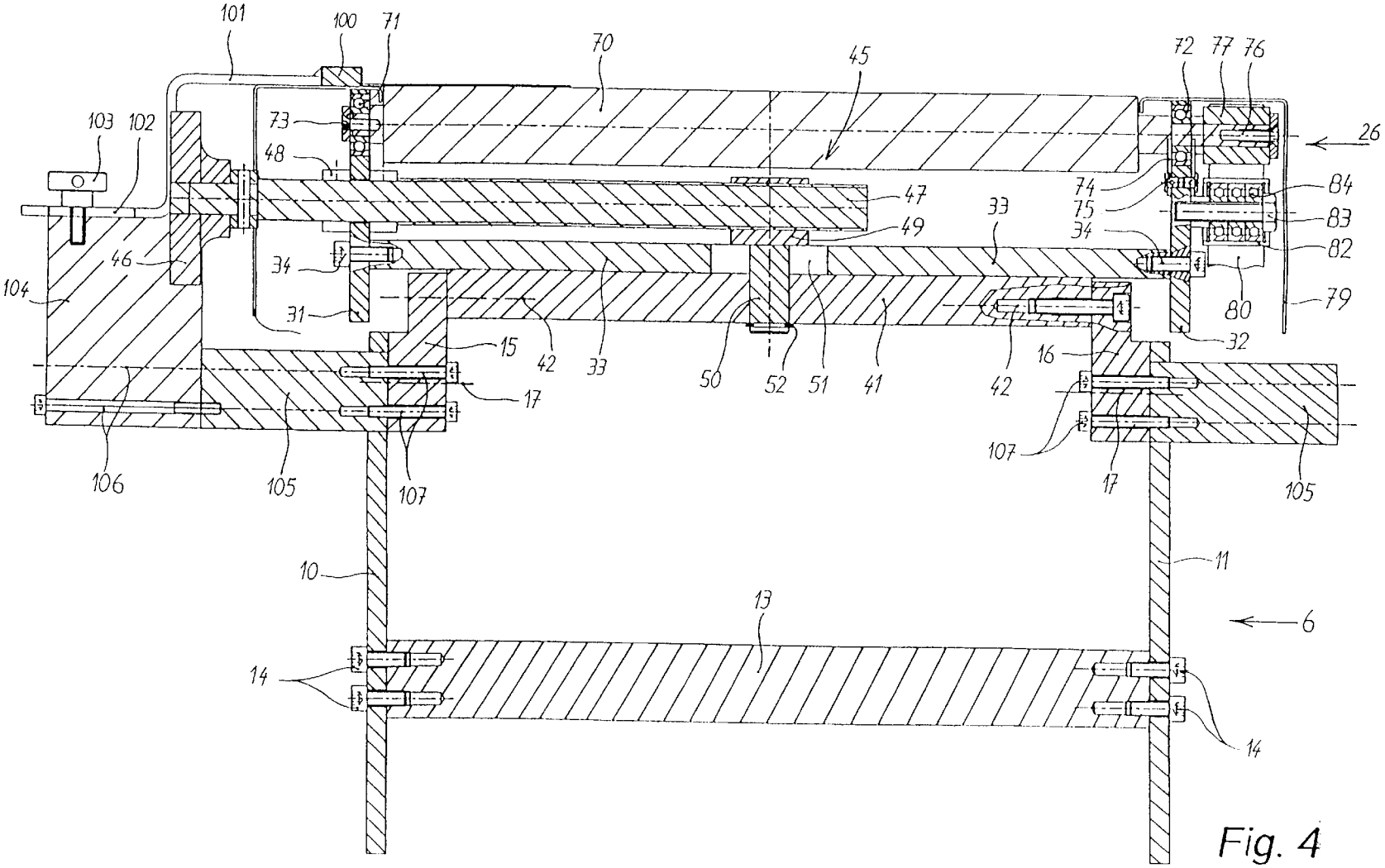
FIG. 4 is a simplified cross-sectional view o the corrective device according to line 1—1 of FIG. 3.

As shown more clearly in FIGS. 2 and 4, the base of the correction device 1 is a transversally sliding lower structure 6 consisting of two rectangular plates 10 and 11 vertically arranged on opposite sides of the longitudinal axis 7 of the correction device 1. These plates are rigidly locked with one another by two crossbars 12 and 13, which are screwed at their ends to the plates 10 and 11 by screw pairs 14. At the upper end of and along each plate are fixed two longitudinal bars 15 and 16 screwed by a plurality of screws 17 against the inner panels of these plates. Two axis 18 and 19, resting on the frames 2 and 3, extend through the correction device 1 and allow its transversal sliding owing to two pairs of smooth bearings 20, 21 arranged in each plate 10 and 11 (FIG. 3). Each smooth bearing is lubricated by lubricators 22. The transveral moving of the correction device 1 along the axes 18 and 19 is actuated by the rotation of a wheel 23 screwed on one nut 24 arranged in the plates 10 and 11 through ball bearings 25. These nuts turn around a screw 27 fastened at its ends on the frames 2 and 3. The screw 27 may be duplicated by a same mechanism provided upstream of the correction device, at the place shown by the axis lines 28 against the plate 11.

Figure 6:
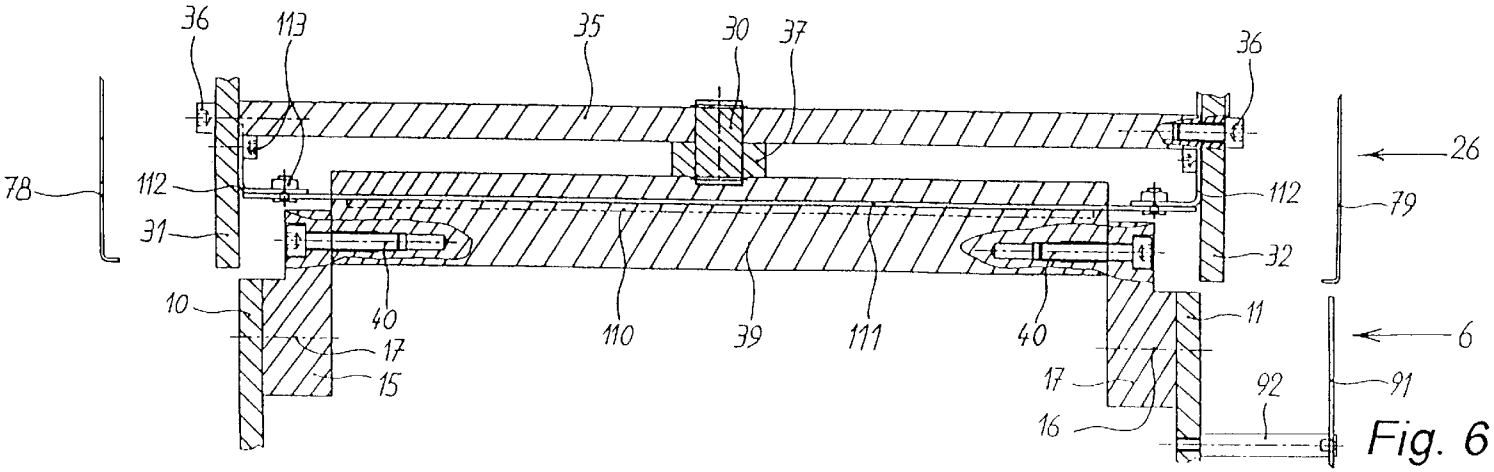
FIG. 6 is a simplified cross-sectional view of the corrective device according to line 3—3 of FIG. 3.

As shown in FIGS. 4 and 6, the upper structure 26 of the device 1 is arranged above the lower structure 6, which structure is rotatable in a horizontal plane around a pivot point 30. The structure forming the base of this upper part mainly consists of two longitudinal bars 31 and 32, respectively arranged on the operator's side and opposite the operator's side. These longitudinal bars are separated upstream by a plate 33 horizontally arranged and screwed in each longitudinal bar by screw pairs 34, and downstream by a distance piece 35 screwed at its ends by the screws 36 and crossed in its median part by the pivot point 30. This pivot point 30, axially held by circlips, is supported by a beam 37, which is longitudinally arranged in the axis 7 of the correction device 1 and held protruding by two screws 38 (FIG. 3) on a plate 39 being horizontally fastened by two screw pairs 40 at the downstream end between the two longitudinal bars 15 and 16. Another plate 41 is provided in the upstream part of the correction device 1, which plate is similar to and mounted opposite the plate 39 in the same manner by means of screws 42 crossing the longitudinal bars 15 and 16. This plate 41 constitutes the main support of the mechanism 45 for pivoting the upper structure 26 of the correction device 1, in both directions in a limited stroke around the pivot point 30.

The pivoting mechanism is actuated by the rotation of a flywheel 46 arranged on the operator's side upstream the correction device 1 on the upper structure 26 (FIG. 2). This flywheel is pinned on a screw 47 extending through, first, a set collar 48 arranged in the longitudinal bar 31, then a threaded block 49 forming a supporting element which cannot be spaced transversally from the axis 7. For this purpose, this block comprises at its base an axis 50 extending through, first, the plate 33 being rigidly locked with the upper pivoting structure 26, then the plate 41 being rigidly fastened to the lower sliding structure 6 (FIG. 4). In order to ensure a degree of freedom in the movements of the plate 33 around the axis 50, this plate is provided with a large rectangular opening 51, the length of which being equal to the maximum stroke of the upper structure 26 pivoting on the lower structure 6 (FIG. 2). In order that the screw 47 may translate the rotary movement of the upper structure 26 while being rigidly locked with it, it is necessary that the threaded block 49, through its axis 50, is able of both, to turn on itself and to move through the plate 41 in a longitudinal movement along the axis 7 of the correction device. To this end, the axis 50 is held in its vertical plane by a circlip 52 while being able to move longitudinally through an oblong opening 53 provided in the plate 41 along the axis 7.

Figure 5:
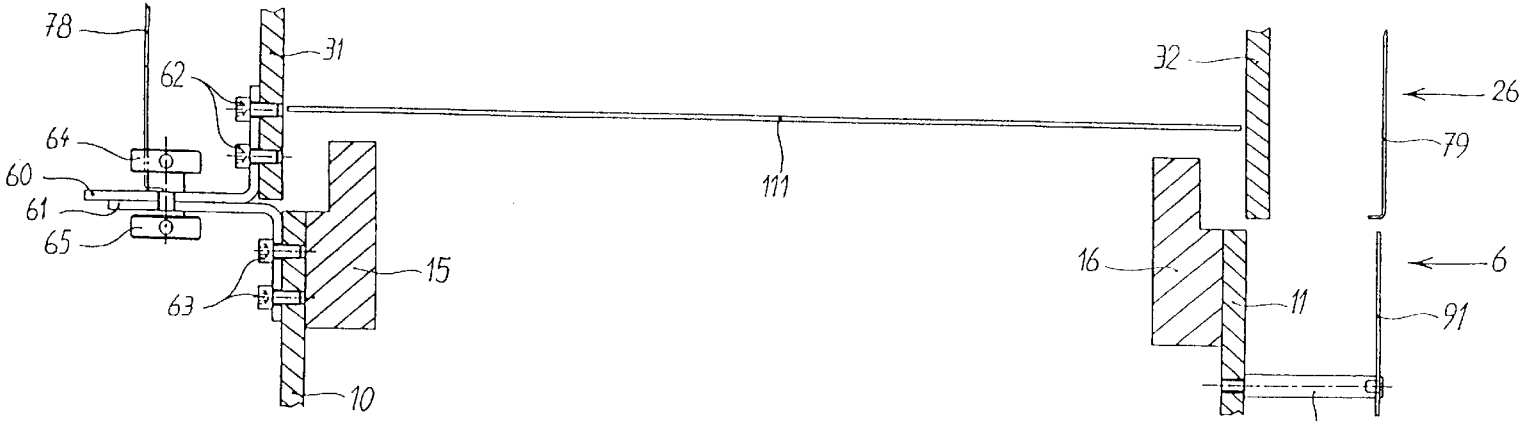
FIG. 5 is a simplified cross-sectional view of the corrective device according to line 2—2 of FIG. 3.

The locking of the upper structure 26 in a slanted position 55 given by the axis is illustrated in FIG. 5 and obtained by interclamping of two squares 60 and 61, one being rigidly locked with the upper structure and the other with the lower structure of the correction device. The upper square 60 is screwed in the longitudinal bar 31 by two screws 62, and the lower square 61 is rigidly locked with the plate 10 by means of two screws 63. Two knurled knobs 64 and 65, extending through the two squares, allow to lock the pivoting mechanism 45.

The traveling workpieces 8 are conveyed by a plurality of rollers 70 aligned side by side and their ends resting in ball bearings 71 and 72 housed in the upper part of the longitudinal bars 31 and 32. On the operator's side, as shown in FIG. 4, the corresponding end of the roller 70 is mounted in the boring of the bearing 71 by a screw 73. On the opposite, each bearing 72 is axially held on each side by a stop plate 74 screwed on the longitudinal bar 32 by a plurality of screws 75. At the end C.O.C., a screw 76 holds a pulley 77 on the end of each roller 70. Two bent protection plates 78 and 79 are mounted along each longitudinal bar 31 and 32 and form a guard against the exposed lateral parts of the rollers.

The sinuous run of a belt 80 around pulleys 77 and around a plurality of return pulleys 82 is chain-dotted illustrated in FIG. 3. Each return pulley 82 is mounted on the longitudinal bar 32, opposite the operator's side, by a screw 83 crossing its ball bearing 84. The whole driving device of the rollers 70 is located opposite the operator's side outside the plate 11 and the longitudinal bar 32. The belt 80 is set into action by the rotation of a driving pulley 85 having a large diameter, mounted on at least a ball bearing 86 which is crossed by a hexagonal drive shaft 87. This drive shaft 87 is held at its ends by ball bearings, housed against the frames 2 and 3 of the folder-gluer and driven at its end C.O.C. by a transmission shaft 88 located in a chute 89 along the external surface of the frame 3 (FIG. 2). As a security, an extractable protection 90, mounted against the inner surfaces of the frames 2 and 3, covers the drive shaft 87 in the two areas outside the plates 10 and 11. A second protection 91, consisting of a trapezoidal plate held against the plate 11 by distance pieces 92, completely covers the drive of the belt 80 and thus avoids any risky access to this moving part (FIGS. 1 and 5). The advancing belt 80 passes by a tension pulley 93, the position of which being adjustable in the horizontal plane by a setting screw 94. This tension pulley can freely slide along the longitudinal bar 32 in a groove 95 in order to rest, by tension of the belt, against the setting screw 94. This setting screw 94 is supported by a threaded block 96 mounted by two screws against the external surface of the longitudinal bar 32.

In order to restore the initial lateral alignment of the traveling workpieces 8, FIGS. 1 and 4 show a longitudinal guiding rail 100, welded against the lateral edges of two metallic tongues 101, each provided with an oblong opening 102 for positioning this rail at various distances from the frame 2, in a parallel direction to the axis 7 of the folder-gluer. In practice, the inner edge of this rail has to coincide with the axis 9 materializing the virtual line against which the corresponding edge of each workpiece leaving the correction device has to be aligned. Two wheels 103 ensure the clamping of the guiding rail, which has been correctly positioned by means of two graduated rules, for example. Each wheel 103 is screwed, on the operator's side or opposite the operator's side, in a support 104 mounted on a distance piece 105 by two screws 106. The distance piece 105 is mounted by two screws 107 on the crossbar 15 or 16, respectively through the plate 10 or 11.

To ensure an adequate friction between the workpieces 8 and the conveying rollers, a fan 110, centred on the axis 55, is arranged just underneath the rollers 70 so as to create a suction source flattening the traveling workpieces 8 against the upper surface of the rollers. As more clearly shown in FIGS. 3 and 6, this suction source 110 is mounted on a perforated plate 111 upwardly bent in its ends and occupying the whole surface available between the longitudinal bars 31 and 32. Squares 112 and fastening screws 113 hold this perforated plate against the inner surfaces of the longitudinal bars 31 and 32. As shown in FIG. 3, a second perforated and retractable plate 114 is arranged above the workpieces traveling on the rollers 70 and thus avoids the natural raising of their previously folded parts.

Numerous improvements can be applied to this device in the scope of the claims.

What is claimed is:

1. An orientation correction device for use in a folder gluer, the orientation correction device comprising:

(A) a lower structure;

(B) an upper structure pivotally connected to the lower structure for pivoting in a horizontal plane, said upper structure including;

(1) a conveying surface on which articles to be reorientated can be supported and moved in a conveying direction; and (2) a guide element for guiding the movement of the articles across the conveying surface along the conveying direction;

(C) a motor for driving the conveying surface at adjustable speeds and thereby moving articles located thereon in the conveying direction;

(D) a source of suction for pressing the articles against the conveying surface with sufficient force to ensure that the articles move at the speed of the conveying surface irrespective of the specific gravity of the articles.

2. A device according to claim 1, wherein the conveying surface is a conveyer belt.

3. A device according to claim 2, wherein further including a plurality of conveyor rollers supporting the conveying belt.

4. A device according to claim 2, wherein the conveyor belt is air permeable.

5. A device according to claim 1, wherein the conveying surface is a plurality of rollers.

6. A device according to claim 1, wherein the motor is an adjustable speed motor.

7. A device according to claim 1, wherein the lower structure is moveable in a direction perpendicular to the conveying direction.

8. A device according to claim 7, wherein the lower structure moves along two guiding elements on which the lower structure is supported via respective bearings.

9. A device according to claim 7, wherein the lower structure is manually moveable.

10. A device according to claim 7, wherein the lower structure is automatically driven.

11. A device according to claim 1, wherein the lower structure includes a plate having a low coefficient of friction and wherein the upper structure is rotatable supported on the plate.

12. A device according to claim 11, wherein the upper structure is rotatably coupled to the lower structure via a pivot which permits the upper structure to rotate in opposite directions relative to the lower structure and further including an actuator rigidly locked to the upper structure for rotating the upper structure relative to the lower structure.

13. A device according to claim 12, wherein the actuator is arranged near one end of the upper surface.

14. A method comprising:

providing a folder gluer having an orientation correction device comprising:

(A) lower structure;

(B) an upper structure pivotally connected to the lower structure for pivoting in a horizontal plane, said upper structure including;

(1) a conveying surface on which articles to be reorientated can be supported and moved in a conveying direction; and (2) a guide element for guiding the movement of articles across the conveying surface alone the conveying direction;

(C) a motor for driving the conveying surface at adjustable speeds and thereby moving articles located thereon in the conveying direction;

(D) a source of suction for pressing the articles against the conveying surface with sufficient force to ensure that the articles move at the speed of the conveying surface irrespective of the specific gravity of the articles; and using the orientation correction device in a production line for the manufacture of packaging articles by folding and gluing the packaging articles from paper blanks.

15. A method according to claim 14, wherein the orientation correction device is located upstream of a device which rotates the paper blanks after they have been subject to at least one folding and gluing operation.

16. A method according to claim 14, wherein the orientation correction device further includes holding means located above the articles and being retractable to a position wherein they do not obstruct the path of the articles.

17. A method comprising:

providing a folder gluer having an orientation correction device including:

(A) a lower structure;

(B) an upper structure pivotally connected to the lower structure for pivoting in a horizontal plane, said upper structure including;

(1) a conveying surface on which articles to be reorientated can be supported and moved in a conveying direction, the lower structure being movable in a direction perpendicular to the conveying direction; and (2) a guide element for guiding the movement of the articles across the conveying surface along the conveying direction;

(C) a motor for driving the conveying surface at adjustable speeds and thereby moving articles located thereon in the conveying direction;

(D) a source of suction for pressing the articles against the conveying surface with sufficient force to ensure that the articles move at the speed of the conveying surface irrespective of the specific gravity of the articles; and using the orientation correction device in a production line for the manufacture of packaging articles by folding and gluing the packaging articles from paper blanks.

18. A method according to claim 17, wherein the orientation correction device is located upstream of a device which rotates the paper blanks after they have been subject to at least one folding and gluing operation.

19. A method according to claim 17, wherein the orientation correction device further includes holding means located above the articles and being retractable to a position wherein they do not obstruct the path of the articles.

20. A method comprising:

(A) a lower structure which includes a plate having a low coefficient of friction;

(B) an upper structure pivotally connected to the lower structure for pivoting in a horizontal plane, the lower structure including a plate having a low coefficient of friction, the upper structure being supported on the plate, said upper structure including;

(1) a conveying surface on which articles to be reorientated can be supported and moved in a conveying direction; and (2) a guide element for guiding the movement of the articles across the conveying surface alone the conveying direction;

(C) a motor for driving the conveying surface at adjustable speeds and thereby moving articles located thereon in the conveying direction;

(D) a source of suction for pressing the articles against the conveying surface with sufficient force to ensure that the articles move at the speed of the conveying surface irrespective of the specific gravity of the articles; and using the orientation correction device in a production line for the manufacture of packaging articles by folding and gluing the packaging articles from paper blanks.

21. A method according to claim 20, wherein the orientation correction device is located upstream of a device which rotates the paper blanks after they have been subject to at least one folding and gluing operation.

22. A method according to claim 20, wherein the orientation correction device further includes holding means located above the articles and being retractable to a position wherein they do not obstruct the path of the articles.

* * * * *